United States Patent [19]

Logue

[11] Patent Number: 4,522,438

[45] Date of Patent: Jun. 11, 1985

[54] RETRIEVER AND DISPENSER FOR DEFORMABLE BALLS

[76] Inventor: DeWitt M. Logue, P. O. Box 988, Longview, Tex. 75606

[21] Appl. No.: 568,702

[22] Filed: Jan. 6, 1984

[51] Int. Cl.[3] ..... A63B 47/02

[52] U.S. Cl. ..... 294/19.2; 221/65; 221/306

[58] Field of Search ..... 294/19 A; 206/315.9; 211/14, 15; 221/65, 185, 199, 188, 281–283, 303, 306, 309, 310; 224/919; 273/29 R, 32 D, 162 E, 201

[56] References Cited

U.S. PATENT DOCUMENTS

| | | | |
|---|---|---|---|
| 1,840,439 | 1/1932 | Ewell | 221/306 X |
| 2,212,129 | 8/1940 | Rust | 221/283 X |
| 2,468,497 | 4/1949 | Johnson et al. | 221/65 X |
| 3,149,872 | 9/1964 | Ward | 294/19 A |
| 3,313,448 | 4/1967 | Suttle et al. | 221/185 X |
| 3,601,250 | 8/1971 | Merila | 221/188 X |
| 4,045,068 | 8/1977 | Nelson | 294/19 A |
| 4,082,209 | 4/1978 | Sanders | 221/309 X |
| 4,088,251 | 5/1978 | Rodriguez | 294/19 A X |

FOREIGN PATENT DOCUMENTS

| | | | |
|---|---|---|---|
| 446938 | 3/1948 | Canada | 211/14 |
| 3132761 | 3/1983 | Fed. Rep. of Germany | 294/19 A |
| 2454820 | 12/1980 | France | 294/19 A |
| 670984 | 4/1952 | United Kingdom | 211/14 |

*Primary Examiner*—Johnny D. Cherry

*Attorney, Agent, or Firm*—Gunn, Lee & Jackson

[57] ABSTRACT

An elongated tubular member for retrieving and dispensing deformable balls, such as tennis balls, is provided with retrieving structure at one extremity and dispensing structure at the opposite extremity. The retrieving structure forms an inlet opening having internal projections requiring deformation of a ball being forced through the inlet opening. The dispensing structure forms a dispensing opening and a restraining lip preventing inadvertent movement of the lowermost ball through the dispensing opening. The dispensing structure also forms a manual access opening, permitting access to the lowermost ball by the fingers of the user to permit dispensing movement of the lowermost ball. The dispensing structure also forms a rotatable closure for the dispensing opening to secure balls within the tubular member for storage. The tubular member is formed by telescoping tube sections permitting the tubular member to be collapsed for storage or extended for use. A locking member is provided to secure the tubular sections at any desirable telescoping position.

15 Claims, 6 Drawing Figures

FIG. 1
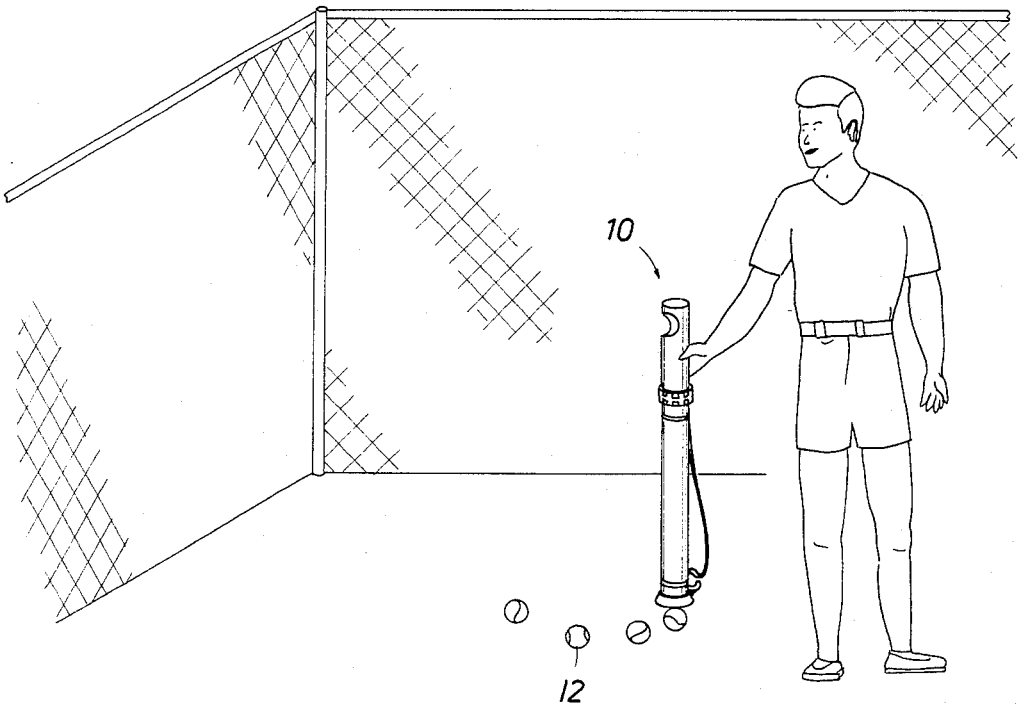
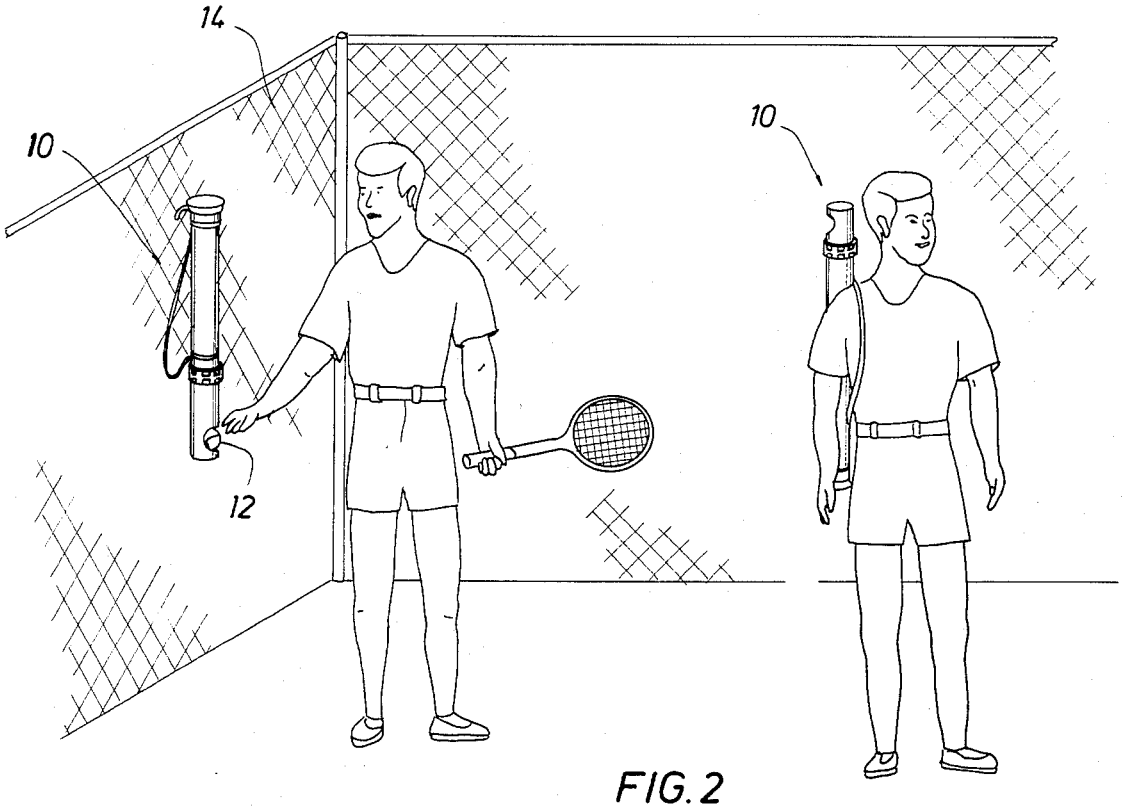
FIG. 2

RETRIEVER AND DISPENSER FOR DEFORMABLE BALLS

FIELD OF THE INVENTION

This invention relates generally to devices for retrieving and/or dispensing balls to thus minimize the manual effort required to gather up loose balls and selectively dispense them. More specifically, the present invention relates to an elongated tubular retriever and dispenser for compressible balls, such as tennis balls, enabling them to be retrieved through an inlet opening at one end of the device and dispensed through a dispensing opening at the opposite end.

BACKGROUND OF THE INVENTION

During practicing of sporting activities such as tennis, players typically hit a large number of balls which then lie about on the tennis court or other playing surface. Players are then typically required to retrieve the balls and place them in a suitable container for storage until use is again desired. In the case of tennis practicing, time studies have determined that far more time is typically spent in retrieving tennis balls from a court than the time actually spent in hitting the tennis balls during practice sessions. Moreover, the retrieval of loose tennis balls can be an extremely tiring effort, requiring the player to bend over a large number of times to pick up balls from the playing surface and place them in a container. It is desirable, of course, to provide apparatus for retrieving and dispensing tennis balls wherein the user will be provided with the capability of achieving greater practice time as compared to the time spent in retrieving the balls. It is also desirable to provide a retrieving and dispensing device for balls which is utilized by persons without the necessity to bend over and pick up balls.

DESCRIPTION OF THE PRIOR ART

A number of devices have been developed over the years for the purpose of enabling more efficient retrieval and/or dispensing of balls such as golf balls, tennis balls and the like. Moreover, certain devices have also been developed which facilitate the retrieval of deformable balls such as tennis balls. One commonly used device takes the form of a large wire basket having a handle by which it is carried by users. The wire forming the lower wall of the basket is spaced slightly less than the diameter of a tennis ball, there being a number of rectangular openings defined by the wire through which a tennis ball may be forced. The user merely sits the wire basket on top of a tennis ball resting on a tennis court and applies downward force. This downward force causes the wires to deform the tennis ball and allow the tennis ball to enter one of the bottom openings of the basket. For dispensing, the basket merely rests on a tennis court or other suitable surface and the user manually gathers balls from the open top of the basket and carries out practice exercises. The large baskets make it difficult to pick up tennis balls which are lying in corners or against side fences of a tennis court. In this case the balls must be moved away from the tennis court such as by the foot of the user, and the wire basket is then used to gather them. This is a cumbersome and tiring activity.

Known patented prior devices which may be pertinent to the present invention include the devices shown in the following patents.

Tubular tennis ball retrieval and dispensing devices are shown by U.S. Pat. Nos. 4,088,251 of Rodriguez and 4,058,336 of Parkinson.

Tennis ball retrieval devices without a dispensing capability are shown by U.S. Pat. Nos. 3,957,297 of Hanks and 4,045,068 of Nelson.

Other U.S. patents of general interest are Fowler, et al, U.S. Pat. Nos. 2,962,321; Motard 3,281,013; Stanworth 3,558,170; Watson 2,760,807 and Ose 4,253,668. British Patent Specification No. 682899 of Nov. 19, 1952, and French Patent No. 2,454,820 disclose tubular devices for picking up and dispensing balls.

SUMMARY OF THE INVENTION

It is, therefore, a primary feature of the present invention to provide a novel device for retrieving and dispensing deformable balls, such as tennis balls and the like which enables a user to pick up balls without necessitating that the user bend over a number of times.

It is a further feature of this invenion to provide a novel ball retrieval and dispensing device which is effective for picking up balls lying in corners or adjacent fences without necessitating first moving them to an unobstructed area.

It is an even further feature of the present invention to provide a novel device for retrieving and dispensing tennis balls and the like which is positionable at any suitable level for dispensing and which positions the balls in serial manner for dispensing.

Among the several features of this invention is contemplated the provision of a novel retrieval and dispensing device for tennis balls and the like which is extendable to a significant length for use and which is collapsible to approximately 50% of that length for the purpose of storage.

It is also a feature of this invention to provide a novel retrieval and dispensing device for tennis balls and the like which includes a lockable closure to facilitate efficient storage of balls without the possibility of the balls becoming inadvertently separated from the device during storage or transportation.

It is also a feature of this invention to provide a novel retrieval and dispensing device for tennis balls and the like which is capable of being manually transported by means of a shoulder strap, thus permitting the user to have the hands free for other activities such as when walking to or from a practice court.

Briefly, the present invention is in the form of an elongated tubular housing which may be formed by two or more tubular, telescoping sections which have a facility for being locked in assembly by a suitable locking device. The tubular retrieving and dispensing device may be extended to a long length for use or it may be collapsed to a much shorter length for efficient storage and transportation. At one end of the tubular retrieval and dispensing device is provided retrieving means which is generally in the form of a retrieval cap that is fixed to one end of the tubular sections. The retrieval cap defines an inlet opening of slightly larger diameter than the diameter of the balls being retrieved. The retrieving cap also defines a plurality of radially inwardly directed projections which are equally spaced about the inlet opening. As a deformable ball is forced through the inlet opening, these projections cause slight deformation of the ball. After the ball has been forced through the inlet opening, the radially extending projections function to support the ball to prevent it from falling out of the inlet opening. The projections provide sufficient resistance to support an entire column of serially arranged balls within the internal passage. Each projection forms a tapered guide surface to thus enable the retrieval extremity of the device or the ball being retrieved to be guided into retrieving relation with the inlet opening such that the ball may be forced through the opening and into an elongated internal storage passage defined by the tubular housing.

After the internal passage has been filled with balls, the elongated tubular member is then inverted, thus positioning a dispensingg structure at its lower extremity in this inverted position. The retrieval cap structure also defines a hook enabling the tubular member to be supported by the hook on any suitable object such as a wire fence, for example, to thus locate it away from the playing surface, where it otherwise might constitute a hazard to the user who might be moving about the court without paying full attention to its presence.

With the ball retrieving and dispensing device positioned in inverted manner, its lower extremity is defined by a dispensing structure having facility for being open to permit dispensing or being closed to secure the balls within the internal passage for storage. A dispensing opening is formed in the side wall at the lower portion of the tubular member slightly above the lower end thereof. A dispensing cap is rotatably secured to the lower portion of the tubular member and provides a transverse bottom wall for supporting the lowermost ball of the serially oriented balls contained within the internal passage. A restraining lip is defined by the lower portion of the tubular member and by the dispensing cap which functions to retain the lower ball within the internal chamber and prevent its inadvertent dispensing. A manual access opening of elongated form is defined by the bottom wall of the dispensing cap, thereby enabling the user to insert the fingers through the opening and into engagement with the lower ball. By applying slight upward and transverse force, the lower ball is moved upwardly over the restraining lip and is ejected through the dispensing opening where it falls into the open hand of the user.

The dispensing cap is provided with an upstanding wall having a dispensing slot or opening therein. The dispensing opening is brought into registry with the dispensing opening of the tubular member in the open position thereof to permit dispensing of balls. In the closed position, the upstanding wall is rotated to a position blocking the dispensing opening, thus providing for efficient storage of the balls until use is desired.

The elongated tubular member may be composed of a pair of telescoping tubular sections which are capable of extension to a long length, for example, in the order of four feet and which may be telescoped to a collapsed position of short length, i.e., in the order of two feet in length. The telescoping sections may be locked at any suitable position by means of a circular locking member having threaded engagement with the outer telescoping section. Upon threaded tightening of the locking member, friction resistance is established between the telescoping sections to thus lock them at the desired telescoping position.

Other and further objects, advantages and features of the present invention will become apparent to one skilled in the art upon consideration of this entire disclosure, including the specification, claims and the annexed drawings. The form of the invention which will now be described in detail illustrates the general principles of the invention, but it is to be understood that this detailed description is not to be taken as limiting the scope of the present invention.

BRIEF DESCRIPTION OF THE DRAWINGS

So that the manner in which the above recited features, advantages and objects of the present invention are attained and can be understood in detail, more particular description of the invention briefly summarized above, may be had by reference to the embodiment thereof which is illustrated in the appended drawings, which drawings form a part of this specification.

It is to be noted, however, that the appended drawings illustrate only a typical embodiment of this invention and are, therefore, not to be considered limiting of its scope, for the invention may admit to other equally effective embodiments. Referring now to the accompanying drawings, which are for illustrative purposes only:

FIG. 1 is a pictoral representation of a user retrieving tennis balls with a retrieving and dispensing device constructed in accordance with the present invention.

FIG. 2 is a pictoral representation of the ball retrieval and dispensing device of the present invention being supported by a wire fence in position for dispensing of balls or being supported by a shoulder strap on the body of the user.

DETAILED DESCRIPTION OF PREFERRED EMBODIMENT

Figure 3:
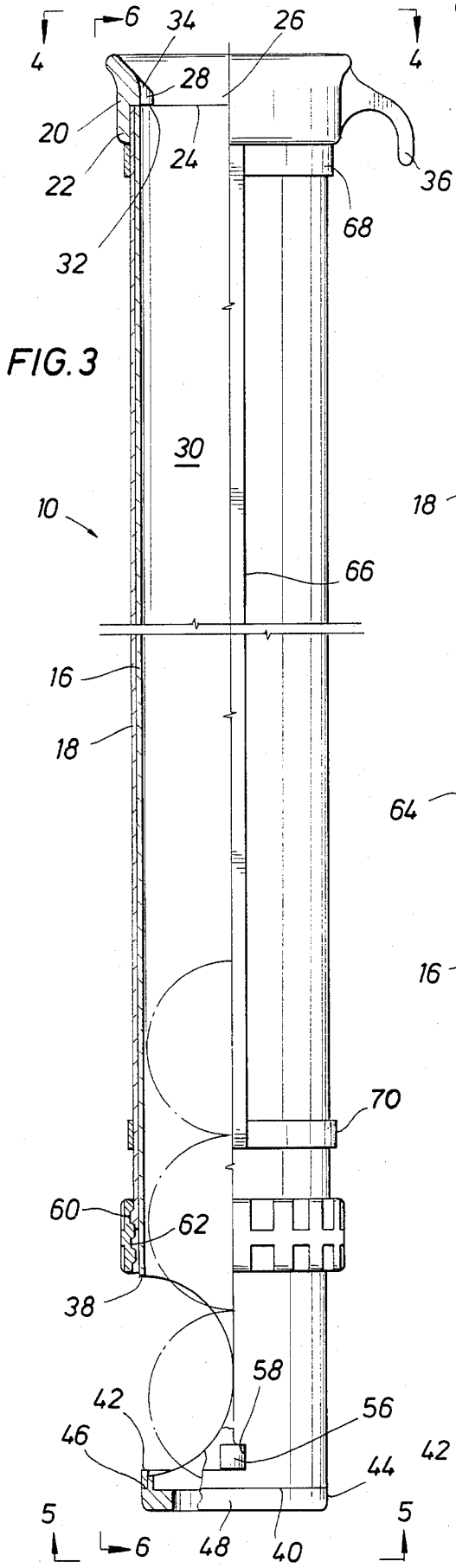
FIG. 3 is a sectional view of the ball retrieving and dispensing device of FIGS. 1 and 2 showing the collapsed position thereof.

Referring now to the drawings and first to FIG. 1, a user is shown in the pictoral representation supporting a ball retrieval and dispensing device illustrated generally at 10, which is adapted for picking up balls, 12, which are tennis balls, or balls of other deformable construction. As shown in FIG. 2, the ball retrieval and dispensing device, 10, is shown being supported by the wire of a fence, 14, and being inverted relative to the position shown in FIG. 1 for the purpose of supporting retrieval balls in serial manner for selective dispensing by the user.

Referring now to FIG. 3, the ball retrieval and dispensing device, 10, is in the general form of an elongated tubular housing which is defined by inner and outer telescoping housing sections, 16 and 18, which, for example, may be formed of any one of a number of suitable plastic or metal materials. More preferably, for the purpose of durability, the tubular housing sections, 16 and 18, are formed of plastic material which will not become permanently dented, bent or otherwise deformed during storage, transportation, or use. In the position shown in FIG. 3, the outer housing section, 18, is provided with a generally circular ball retrieval cap, 20, which forms a circular skirt or flange, 22, that is received in tight-fitting relation about the upper extremity of the outer housing section. The ball retrieval cap also defines an internal circular abutment shoulder, 24, against which the upper extremity of the outer tubular section is abutted. The ball retrieval cap may be cemented, bonded, or otherwise affixed to the outer tubular section in any suitable manner.

It is desirable that balls be guided to a retrieval opening formed by the device and that suitable force be applied to force the ball through the retrieval opening and into an internal chamber for passage formed by the device. For this purpose, the ball retrieval cap, 20, defines a generally circular ball retrieval opening, 26, which is of slightly larger diameter than the diameter of the balls to be retrieved. A plurality of radially inwardly extending projections, 28, are formed integrally or otherwise provided on the ball retrieval cap. These projections form restrictions to passage of a ball through the inlet opening, 26, and into an elongated internal passage, 30, defined by the tubular members. In order for a deformable ball, such as a tennis ball, to pass through the opening, 26, into the passage, 30, it must be forced past the ball deforming projections, 28. Tennis balls and other deformable balls of like nature may be forced past the radial projections, 28, simply by applying a downward force on the ball retrieval and dispensing device in the position shown in FIG. 1. After the ball has entered the tubular passage, 30, abrupt shoulders, 32, form restrictions to support the lowermost tennis ball within the tubular passage and thus prevent it from falling out of the retrieval opening. For the purpose of guiding the balls and the tubular member for registry of the balls with the retrieval opening, 26, the radial projections are formed to define tapered guide surfaces, 34. Guide surfaces, 34, are tapered toward the inlet opening, 26, such that when a ball is engaged in off-center relation by the ball retrieval cap, either the ball or the ball retrieval cap or both will be shifted transversely for proper orienting relation with the inlet opening. The tapered guide surfaces, therefore, establish proper orienting relationship between the ball and opening, 26, such that a simple downward force on the device as shown in FIG. 1 causes the ball to be forced past the radial projections and into the elongated passage, 30, of the device.

The ball retrieval cap, 20, also forms a hook member, 36, which may be integral with the cap structure. The hook member, 36, is employed to support the ball retrieval and dispensing device in the dispensing position thereof as shown in FIG. 2. The hook member, 36, may be brought into engagement with the wire of a wire fence or with any other suitable support object for support of the device in a position sufficiently elevated that a ball may be grasped and removed from the device without necessitating bending of the user's body. Moreover, the device may be supported in an elevated, out of the way, position so that it does not present an obstruction or hazard on the playing surface. In many cases, conventional ball dispensing devices must rest on a playing surface and thus present a serious safety hazard to the uwer who frequently moves about the playing surface with rapid movements determined by the force and direction of the approaching ball and without paying full attention to the presence of the ball dispenser.

Figure 6:
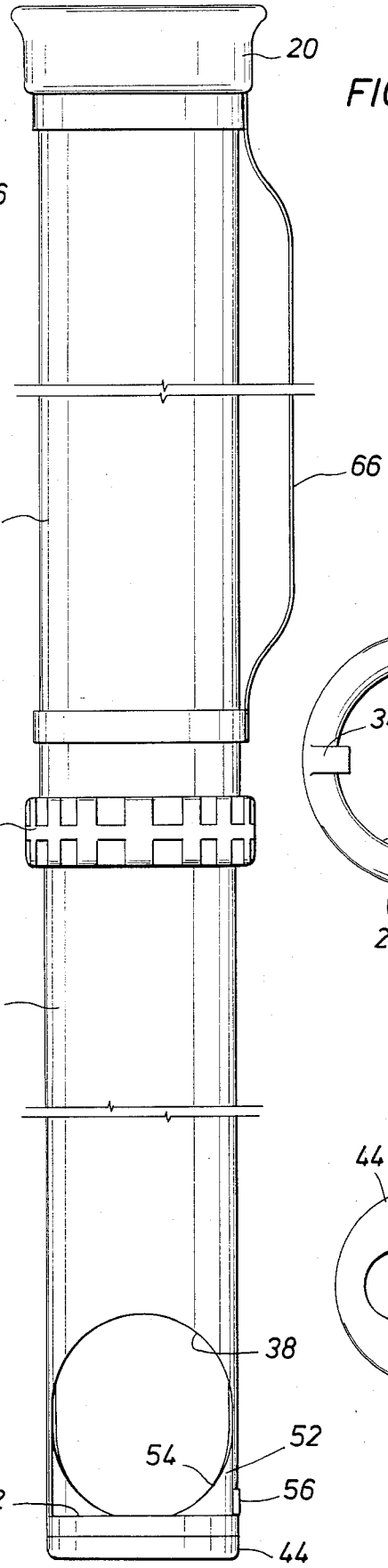
FIG. 6 is an elevational view of the ball retrieval and dispensing device taken along line 6—6 of FIG. 3 and showing the extended relationship of the telescoping tubular sections thereof.
Figure 4:
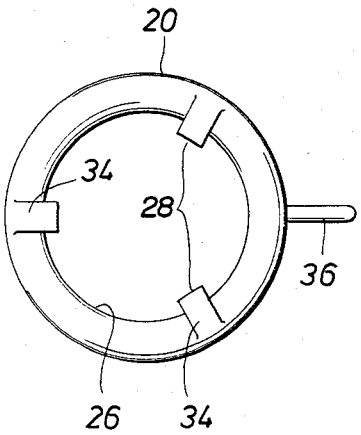
FIG. 4 is an end view taken along line 4—4 of FIG. 3.
Figure 5:
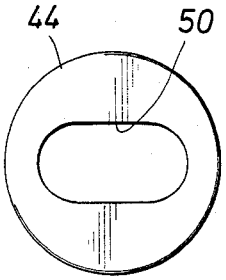
FIG. 5 is an end view taken along line 5—5 of FIG. 3.

With the ball retrieval and dispensing device positioned as shown in FIG. 2, dispensing means is located at the lower extremity thereof and may take the form shown at the lower portion of FIGS. 3 and 6. The lower portion of the inner tubular section, 16, is formed to define a dispensing opening, 38, which is located a short distance above the lower extremity, 40, of the inner housing section, such that the lower portion of the housing defines an upstanding arcuate lip, 42, which functions to restrain transverse movement of the lower serially arranged ball in the internal passage, 30. A dispensing cap, 44, is provided which is of generally circular form and defines an external abutment or shoulder 46, against which is seated a lower extremity, 40, of the inner tubular member. The dispensing cap, 44, defines a substantially planar end wall, 48, which provides support for the lower serially arranged ball within the internal passage. The end wall, 48, is also formed to define an elongated manual access opening, 50, which is best shown in FIG. 5. The fingers of the user may be inserted through the manual access opening, 50, thus providing for manual engagement with the lower ball of the internal passage. The user will then apply sufficient, simultaneous upward and transverse force to move the lower ball upwardly and over the arcuate lip, 42, while simultaneously moving the ball through the dispensing opening, 38, and thus ejecting the lower ball. The elongated manual access opening, 50, is aligned with the dispensing opening, 38, thereby allowing the hand of the user to be positioned to catch the ball as it drops from the dispensing opening. Balls can, therefore, be dispensed singly and as many balls as desired individually collected by the user for practice activities.

It is desirable that the ball retrieval and dispensing device also function efficiently for storage and transportation of balls such as when practice activities are not being conducted. Provision for locked enclosure of balls may conveniently be provided as shown at the lower portion of FIGS. 3 and 6. The arcuate lip, 42, is oriented in substantially normal relation to the vertical center line of the tubular member and extends through a substantial arc of, for example, 180°. The dispensing cap, 44, is provided with an upstanding closure wall, 52, forming an elongated slot or opening, 54, which is of corresponding size with the size of the dispensing opening, 38. The dispensing cap, 44, is also provided with an external projection, 56, which functions to retain the dispensing cap in rotatable assembly with the lower portion of the inner tubular section, 16. The cap supporting projection, 56, is positioned for guiding engagement with the arcuate lip, 42, and is receivable within a recess, 58, of mating configuration which is formed in the wall structure at the lower portion of the inner tubular section. Thus, the dispensing cap, 44, may be rotated through an arc of about 180° in order to position the closure wall, 52, and slot or opening, 54, in the open or closed positions thereof. In the open position, as shown in FIG. 6, the slot or opening, 54, in the closure wall, 52, is in registry with the ball dispensing opening, 38, thereby permitting balls to be ejected through the dispensing opening by application of manual force in the manner described above. The dispensing cap, 44, may then be rotated through an arc of about 180° to thereby position the closure wall, 52, such that it blocks the dispensing opening, 38, and thereby prevents balls from being ejected. The closure wall, in the closed position thereof, also prevents balls from inadvertently falling through the dispensing opening when the device is supported horizontally such as when lying in the luggage compartment of an automobile while being transported or stored, for example. The dispensing cap 44 is sufficiently yieldable that the lug 56 can be forced through the opening of tube 16 such that it simply snaps into place during assembly. Following assembly, the lug 56 maintains the dispensing cap in movable assembly with the tube 16.

It is desirable that the elongated tubular ball retrieval and dispensing device be of sufficient length to contain a significant number of balls for efficient practice activities and yet that it be capable of being reduced in length for efficient storage and handling. Accordingly, the device may conveniently take the form shown in the figures, where the lower portion of the outer housing section, 18, is formed to define external threads, 60, which receive the internal threads, 62, of a circular locking ring, 64. The internal threads, 62, are of tapered design, and therefore when threaded tightly to the external threads, 60, of the outer tubular section, the outer tubular section is forced into friction tight assembly with the inner tubular section, 60. Thus, the locking ring, 64, is capable of securing the telescoping housing sections, 16 and 18, in friction tight, fixed relation regardless of of the relative telescoping positions thereof. As shown in FIG. 3, the inner and outer tubular sections are fully telescoped and the ball retrieval and dispensing device is of minimized length. As shown in FIG. 6, the telescoping tubular sections, 16 and 18, are fully extended and locked by means of the locking ring, 64. The locking ring, 64, is provided with external spaced ridges similar to knurlings to thereby provide a roughened external surface for ease of manipulation by the user.

For support of the ball retrieval and dispensing device on the body of the user, an adjustable support strap is provided as shown at 66, which is secured to support rings, 68 and 70, that are positioned about the respective extremities of the outer tubular housing section, 18. For manual transportation to and from a place of use, the user will simply place the shoulder strap, 66, about his or her shoulder thereby permitting the hands to be free for other activities.

In view of the foregoing, it is respectfully submitted that the present invention is one well adapted to attain all of the objectives and features hereinabove set forth together with other features which are inherent in the apparatus itself. It will be understood that certain combinations and subcombinations are of utility and may be employed without reference to other features and subcombinations. This is contemplated by and is within the scope of the present invention.

What is claimed is:

1. A retriever and dispenser for compressible balls such as tennis balls and the like comprising:

(a) an elongated tubular member having an internal passage of slightly greater dimension than the diameter of the balls to be contained therein, said tubular member defining first and second extemities, said second extremity forming a first dispensing opening;

(b) retrieving means at said first extremity of said tubular member forming a ball retrieving opening through which balls enter said internal passage, said retrieving means forming restriction means at said ball retrieving opening requiring balls to be slightly deformed as the balls are forced past said restriction means and into said internal passage, said restriction means restraining balls from inadvertently falling from said retrieving opening when said tubular member is positioned vertically with said retrieving opening at the lower end thereof;

(c) a dispensing cap being rotatably connected at said second extremity of said tubular member and forming a transverse bottom wall supporting the lower ball when said tubular member is positioned vertically with said dispensing cap at the lower end thereof, said dispensing cap further defining a wall portion forming a second dispensing opening through which balls are moved transversely of the centerline of said tubular member for dispensing of the same, said first and second dispensing openings being in registry for dispensing of said balls and out of registry to prevent dispensing of said balls; and (d) means restraining free transverse dispensing movement of said balls from said internal passage and permitting manually induced dispensing of said balls.

2. A retriever and dispenser for compressible balls as recited in claim 1, wherein said restraining means comprises:

a ball restraining lip extending upwardly from said bottom wall and being of sufficient height to restrain free transverse movement of said balls and prevent inadverent dispensing of said balls when said first and second dispensing openings are in registry.

3. A retriever and dispenser for compressible balls as recited in claim 1, wherein:

said bottom wall defines a manual access opening through which the fingers of the user are inserted for engagement with the lowermost one of the balls in said internal passage for inducing manual dispensing movement of said lowermost ball.

4. A retriever and dispenser for compressible balls as recited in claim 3, wherein:

said manual access opening is of elongated configuration with the long axis thereof extending toward said second dispensing opening.

5. A retriever and dispenser for compressible balls as recited in claim 1, wherein:

said restraining means is a lip extending upwardly from said bottom wall of said dispensing cap, said lip permitting passage of a ball through said first and second dispensing openings only upon both upward and transverse movement of said ball.

6. A retriever and dispenser for compressible balls as recited in claim 1, wherein said tubular member comprises:

(a) a pair of tubular sections having telescoping relation and being relatively movable between extended and collapsed positions; and (b) locking means releasably securing said telescoping sections in suitably positioned immovable telescoping assembly.

7. A retriever and dispenser for compressible balls as recited in claim 6, wherein:

said retrieving means is provided on one of said tubular sections and said dispensing cap is provided on the other of said tubular sections.

8. A retriever and dispenser for compressible balls as recited in claim 6, wherein said locking means comprises:

(a) external threads being defined by the outermost one of said telescoping tubular sections; and (b) a circular locking ring forming internal threads receivable by said external threads, said locking ring being threadedly tightened on said external threads to develop a friction locked relation between said tubular sections.

9. A retriever and dispenser for compressible balls as recited in claim 1, wherein said tubular member comprises:

(a) first and second tubular sections; and (b) means releasably securing said tubular sections in releasably fixed coaxial assembly.

10. A retriever and dispenser for compressible balls as recited in claim 1, wherein:

said retrieving means defines an external hook element positioned for support of said tubular member with said retrieving means at the upper extremity of said tubular member and said dispensing cap at the lower extremity of said tubular member.

11. A retriever and dispenser for compressible balls as recited in claim 1, wherein said retrieving means comprises:

a generally circular retrieving cap being secured to one end of said tubular member, said retrieving cap defining:

(1) an inlet opening of slightly greater diameter than the diameter of said balls; and (2) a plurality of radially extending internal projections located in substantially equally spaced relation about said inlet opening, said radially extending internal projections cooperating to cause deformation of balls being forced through said inlet opening, said radially extending internal projections cooperating to support balls within said internal passage to prevent them from falling through said inlet opening.

12. A retriever and dispenser for compressible balls as recited in claim 11, wherein:

said radially extending internal projections form tapered guide surfaces inclined toward said inlet opening, said guide surfaces cooperating to guide said ball through said inlet opening into ball receiving registry with said inlet opening as said tubular member is positioned in retrieving engagement with a ball resting on a playing surface.

13. A retriever and dispenser for compressible balls as recited in claim 1, wherein:

said wall portion of said dispensing cap forms a closure for said first dispensing opening, said closure being selectively positionable at open and closed positions and blocking said first dispensing opening at said closed position.

14. A retriever and dispenser for compressible balls as recited in claim 1, wherein:

(a) said elongated tubular member defines arcuate guide means extending about a portion of the periphery thereof; and (b) said dispensing cap defines a stop element engaging said arcuate guide means, said stop element limiting rotatable movement of said dispensing cap relative to said tubular member, and retaining said dispensing cap in rotatable assembly with said tubular member and rendering said dispensing cap positionable at an open position where said first and second dispensing openings are in registry and a closed position where said wall portion blocks said first dispensing opening.

15. A retriever and dispenser for compressible balls as recited in claim 1, wherein:

a shoulder strap is secured to said tubular member to permit manual support and transportation of said tubular member.

* * * * *